United States Patent [19]

Krauel, Jr.

[11] 4,406,920

[45] Sep. 27, 1983

[54] MONITOR AMPLIPHONES

[76] Inventor: Robert W. Krauel, Jr., 128 Westerfield, Bossier City, La. 71111

[21] Appl. No.: 218,525

[22] Filed: Dec. 22, 1980

Related U.S. Application Data

[63] Continuation-in-part of Ser. No. 951,015, Oct. 12, 1978, Pat. No. 4,245,136.

[51] Int. Cl.[3] ..... H04S 7/00; H04S 3/00

[52] U.S. Cl. ..... 179/1 MN; 179/1 GQ

[58] Field of Search ..... 179/1 G, 1 GA, 1 GP, 179/1 GQ, 1 MN, 156 R, 182 R

[56] References Cited

U.S. PATENT DOCUMENTS 3,878,472 4/1975 Osakabe ..... 179/1 G 3,902,120 8/1975 Dascal et al. ..... 179/156 R 4,245,136 1/1981 Krauel ..... 179/1 GQ

*Primary Examiner*—A. D. Pellinen

*Attorney, Agent, or Firm*—Hubbard, Thurman, Turner & Tucker

[57] ABSTRACT

An improved headphone arrangement in which a first audio signal is coupled to a speaker in each headphone and a second audio signal, usually monaural, is coupled to an amplifier and then to the same speaker in each headphone via an isolation network. Switching circuitry are also provided so that the speaker may be connected directly to the second audio source without amplification. The headphone is used as a musician's practice aid or for track-making or similar purposes. The first audio signal is preferably a prerecorded signal while the second audio signal is preferably the output of the musician's electronic instrument.

3 Claims, 2 Drawing Figures

MONITOR AMPLIPHONES

CROSS REFERENCE TO RELATED APPLICATION

This application is a continuation-in-part of U.S. patent application Ser. No. 951,015, filed Oct. 12, 1978, now U.S. Pat. No. 4,245,136, issued Jan. 13, 1981.

BACKGROUND OF THE INVENTION

The present invention relates to an improved audio headphone, and more particularly to a headphone arrangement including amplification means in one signal path to the speaker in each of the headphones.

Quadraphonic or four-channel headphones are well-known. References which show particular embodiments of such devices are U.S. Pat. No. 3,984,885, issued to Yoshimura, et al on Oct. 12, 1976 and U.S. Pat. No. 3,927,262, issued to Goeckel on Dec. 16, 1975. Generally speaking, such devices comprise an earpiece or headphone for each ear in which is contained at least two separate speakers. The purpose of such headphones is to reproduce quadraphonically recorded information such as music with the overall purpose being of more realistically recording and reproducing sound. The above-referenced patents and the references cited therein generally relate to improvements in such headphones which are intended to avoid the problem generally encountered in headphones in which the source of the sound appears to the listener to be in the center of his head.

Studio musicians are, of course, quite skilled in the art of quadraphonic sound recording and reproduction. Such musicians often use such equipment for listening to a pre-recorded track while simultaneously playing their own instrument as a practice aid. Of course, if a musician is using headphones which tend to block out the sound of his own instrument, he must typically feed the output of his instrument to an expensive electronic mixing network which then electronically combines the recorded soundtrack with the output of his instrument and then couples the mixed output with sufficient power to his headphones so that he is able to compare the prerecorded signal with that which he is generating. Similar equipment is used in the process of overdubbing or re-recording in which a musician performs a particular musical composition a number of times with the same or different instruments with each performance recorded over that previously performed. It is, of course, necessary in such practice that the musician be able to listen simultaneously to be prerecorded track and to his presently performed music.

It can be seen that relatively expensive equipment has been required for such practice track-making, re-recording, etc., since typically studio quadraphonic or stereophonic mixing and amplification equipment has been used to provide the combined signals to the musician's headphones.

Such typical studio practices would also be quite useful for home or classroom practice and teaching. But since the studio equipment is quite expensive, it is not practical for most musicians, especially students, to use the studio methods. The usual practice methods have involved simply playing a recorded selection through standard amplifiers and loud speakers while the musician plays his instrument through separate amplifiers and speakers. In a classroom situation, an instructor may be providing the original audio signal while the students play along trying to compare their performance to the instructor's. In either of these situations, the musicians have the problem, magnified by modern amplifiers, that their practice is a nuisance to others. In addition, if more than one musician tries to practice at the same time, each has trouble distinguishing his individual performance from the others. An instructor would likewise have trouble isolating a particular student's performance from the others.

Thus, it is seen that there is a need for an inexpensive practice aid which allows musicians to listen to two distinct audio signals at the same time for comparison purposes. In addition, the practice aid should isolate the audio signals from the surroundings and isolate the user of the aid from audio signals, other than the two desired signals.

SUMMARY OF THE INVENTION

Accordingly, an object of the invention is to provide an improved but inexpensive headphone arrangement which allows a listener to distinguish between separate signal sources.

Another object of the present invention is to provide a headphone arrangement with which a musician may simulataneously listen to a pre-recorded track and a presently produced original performance for comparison purposes.

Yet another object of the present invention is to provide a headphone arrangement with which a musician may simultaneously amplify and monitor his instrument's output while listening to another audio signal.

These and other objects of the present invention are achieved by providing a headphone having means for coupling a first audio signal to the speaker means in each headphone and means for connecting the output of an instrument through an amplifier to the speaker means. An isolation circuit of any type well known in the art may also be utilized to minimize any fedback problems which might be associated with coupling two signals to a single speaker.

BRIEF DESCRIPTION OF THE DRAWINGS

The present invention may be better understood by reading the following brief description of the preferred embodiments with reference to the accompanying drawings wherein.

DESCRIPTION OF THE PREFERRED EMBODIMENT

Figure 1:
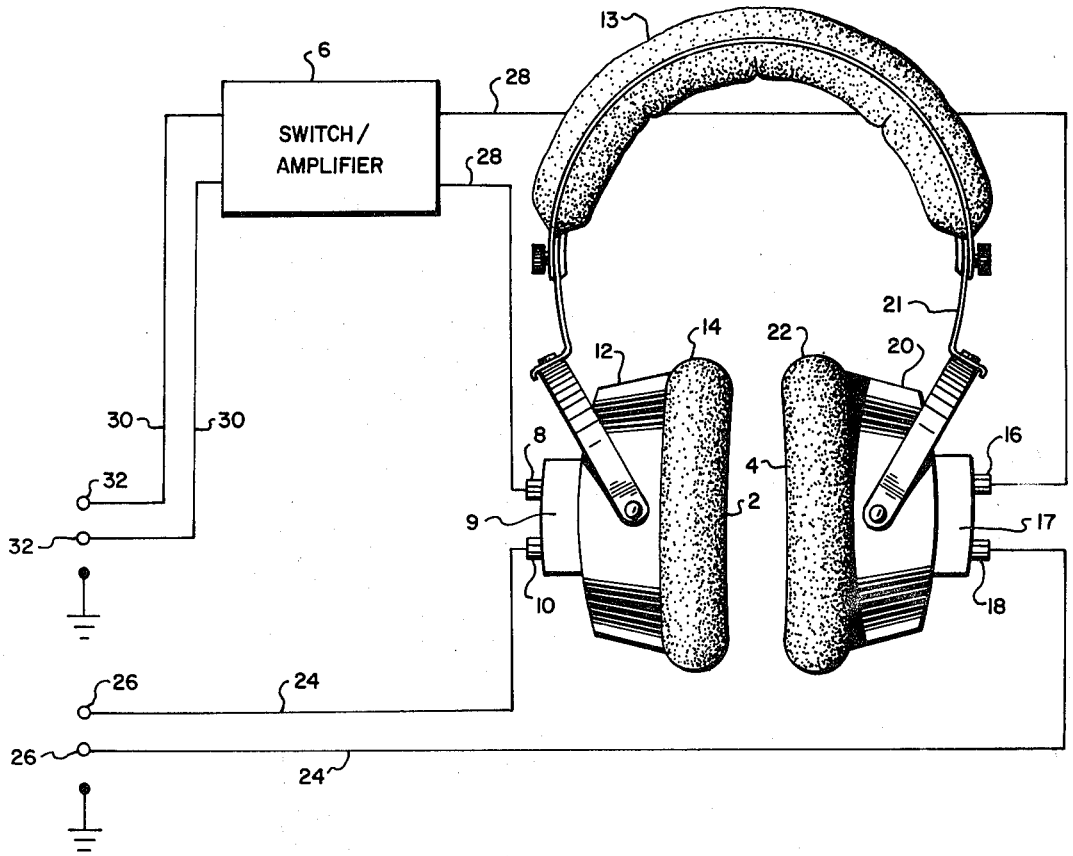
FIG. 1 is a block diagram of the amplifier headphone arrangement of the present invention and FIG. 2 is a schematic illustration of the amplifier and switching network of FIG. 1.

With reference now to FIG. 1, there is illustrated an improved headphone arrangement according to the present invention. This arrangement comprises headphones 2 and 4 and a network 6 containing switching arrangements and at least one amplifier. Headphone 2 comprises first and second speaker inputs 8, 10, isolation network 9, and a single speaker (not shown), mounted in a housing 12 having a cushion 14 around its open edge for sealing to the head of a user. Headphone 4 is essentially identical, having first and second speaker inputs 16 and 18, isolation network 17, and a single speaker (not shown), mounted in a housing 20 having a cushion 22 around its open edge. A pair of leads 24 are connected to speaker inputs 10 and 18 and are adapted at their ends 26 for connection to a source for audio signals, such as a stereo amplifier. It is apparent that each of the leads 24 actually comprises two wires, that is a signal line and a ground return line, while only one is illustrated for simplicity.

The remaining two speaker inputs 8 and 16 are connected by leads 28 to the output of a switching and amplifier box described in more detail with reference to FIG. 2. Inputs to box 6 are connected by leads 30 to a pair of input terminals 32 which are also adapted for connection to a source of audio signals such as a stereo amplifier, but preferably such as a musical instrument. It is apparent in this case also that leads 28 and 30 each comprise a pair of wires instead of a single wire illustrated for simplicity.

While amplifier and switch box 6 is shown as a separate component, it is preferably built in to either housing 12 or 20. This voids the need for a separate housing, thus reducing the overall size, weight, and cost of the whole unit. In addition, it is quite annoying to have a small extra housing hanging in the middle of the connecting wires. The amplifier unit is preferably powered by a nine volt transistor radio battery. It is preferable to mount this battery in the housing 12 or 20 which does not contain the amplifier and switch. In a prototype unit, the battery was placed within a cushion 13 attached to a headband 21 which physically connects the headphones 2 and 4 together and holds them on the user's head.

It is also apparent that while wires 24 and 30 have been illustrated as the means for coupling two sets of signals to headphones 2 and 4, other means would also be suitable. It has now become practical to use low power FM transmitters and receivers to replace microphone or instrument cables. While these are now used principally for stage performances, they would also be adaptable for use with the headphones of the present invention.

While input 32 is described as adapted for connection to the electrical output of, for example, an electric guitar, a microphone input could also be used. Thus, musicians with non-electrical instruments may use a microphone to monitor their instruments and the amplifier in box 6 will provide sufficient power to drive the headphone speakers through speaker inputs 8 and 16.

Figure 2:
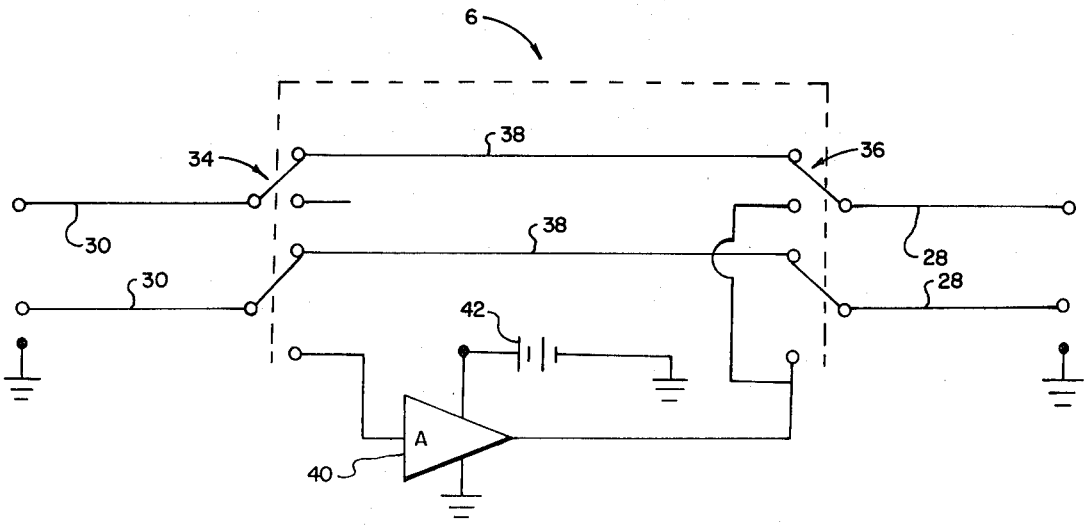

FIG. 2 illustrates one form of the switching and amplifier network 6 of FIG. 1. Input and output leads 30 and 28 are the same as those illustrated in FIG. 1. A first double-pole/double-throw switch 34 is connected to input lead 30 and a second similar switch 36 is connected to output leads 28. The switches 34 and 36 are linked together as shown so that they are all switched simultaneously. In the position illustrated in FIG. 2, the switches 34 and 36 make a direct connection between input 30 and output 28 by means of internal leads 38 within the switching box 6. In the alternate position of switches 34 and 36, one of the two input leads 30 is connected to the input of an amplifier 40 and the output of the amplifier is coupled to both of the output leads 28. With this arrangement, the signal appearing on only one of the leads 30 is amplified and coupled simultaneously to both of the outputs 28. While it is apparent that a second amplifier 40 could be provided for the second input 30, this is unnecessary in most practice, overdubbing, etc., applications. In general the musician using the device is playing one instrument which has a single output and thus his performance is basically monaural. The arrangement of FIG. 2 amplifies this monaural output and couples it to each of the speaker inputs 8 and 16 for comparison to signals received at speaker inputs 10 and 18. Amplifier 40 is powered by a battery 42.

In the prototype, the switch 34, 36 also had a center position at which no contacts were closed. This arrangement provided an "off" position for speaker inputs 8 and 16. Although not illustrated, it is apparent that various filters may be used as tone controls or compensation networks. For example, an input matching network might be desirable if a microphone is connected to inputs 32. Such filters are not used in the preferred form since the invention is intended as a monitor or practice aid and the headphone signals are not being permanently recorded. U.S. Pat. 4,087,631 issued to Yamada, et al on May, 2, 1978, teaches various filter arrangements for improving headphone sound which could be used if desired.

In use, the apparatus of FIG. 1 has been found to provide a very natural feeling which allows the musician to accurately compare his performance to a prerecorded track or other reference. As a result of utilizing two inputs to each speaker, the user of the headphones is able to enjoy the privacy and other advantages of headphones without losing his ability to distinguish his performance from the reference signal. This result is accomplished with the use of equipment which is simple and inexpensive when compared to typical studio mixing and amplifying equipment.

It can be seen that a group of musicians can practice together using the present invention without interfering with each other. Thus, each one can listen to a reference performance on inputs 26 while listening to his own performance by inputs 32. In this way, neither the reference signal nor the practice performance need be amplified through loudspeakers. An instructor may use the arrangement to listen to one student's performance while comparing it to his own reference performance without interference from the rest of the class.

While the present invention has been described as having only one speaker in each earpiece, it is apparent that an additional speaker may be added to each earpiece. A basic four speaker arrangement would allow the musician to monitor a reference stereophonic source while listening to his own performance as a monaural or even stereophonic signal. If it is desired to use a full quadraphonic source as a reference, then four speakers, two in each earpiece, are needed to listen to the reference work. An additional speaker in each earpiece would then be used to monitor the musicians live performance, again as either a monaural or stereophonic source. In this way, the electrical separation of the two signal sources is maintained with the same benefits as found in a preferred embodiment.

While the present invention has been described in terms of particular apparatus and methods used, it is apparent that various modifications and changes can be made within the scope of the present invention as defined by the appended claims.

I claim:

1. Headphone apparatus for comparing a reference performance to an indepdndent performance of a musical work comprising:

right and left earpieces each comprising a generally cup-shaped casing adapted for covering the ears of a listener, only one speaker carried within each of said earpieces, coupling means connected to said speaker in each earpiece for coupling a first source of audio frequency signals representing said reference performance to said speaker, and electronic signal processing means, including amplifier means, having an input adapted for connection to a second source of audio frequency signals representing said independent performance and an output connected to said speaker in each earpiece, for coupling said second source to said speaker, and switching means for, in a first position, coupling said second source directly to said speaker, and in a second position, coupling said second source to said amplifier means and the output of said amplifier means to said speaker.

2. Headphone apparatus according to claim 1 wherein said electronic signal processing means further includes a plurality of electrical conductors connected to said input and adapted for connection to said second source of audio frequency signals.

3. Apparatus according to claim 2 wherein said electronic amplifier means further includes a battery.

* * * * *